US005989129A

United States Patent [19]

O'Neill

[11] Patent Number: 5,989,129

[45] Date of Patent: Nov. 23, 1999

[54] GOLF SWING PRACTICE DEVICE

[76] Inventor: William T. O'Neill, 53-23 192nd St., Flushing, N.Y. 11365-1232

[21] Appl. No.: 09/168,480

[22] Filed: Oct. 8, 1998

[51] Int. Cl.[6] ..... A63B 69/36

[52] U.S. Cl. ..... 473/147; 473/149; 473/145

[58] Field of Search ..... 473/146, 145, 473/147, 149

[56] References Cited

U.S. PATENT DOCUMENTS 2,011,857 8/1935 Holmes ..... 473/146

2,641,933 6/1953 Van Kinkle ..... 473/146

*Primary Examiner*—George J. Marlo

[57] ABSTRACT

A golf practice aid is provided including a base and a ball swinging mechanism including an arm having a first end rotatable with respect to the base about a vertical axis. The ball swinging mechanism further includes a tether cord having a top end coupled to a second end of the arm and upper and lower compartments, including a central gear and a pinion gear mounted on an elastomeric friction element located in the upper compartment. A bottom end of the tether cord is equipped with a golf ball fixed thereto.

9 Claims, 2 Drawing Sheets

GOLF SWING PRACTICE DEVICE

BACKGROUND OF THE INVENTION

1. Field of the Invention

The present invention relates to golf swing aids and more particularly pertains to a new golf swing practice device for practicing a golf swing with a rotating tether-mounted golf ball.

2. Description of the Prior Art

The use of golf swing aids is known in the prior art. More specifically, golf swing aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf swing aids include U.S. Pat. No. 2,510,266; U.S. Pat. No. 5,390,930; U.S. Pat. No. 3,643,961; U.S. Pat. No. 5,366,225; U.S. Pat. Des. 165,196; and U.S. Pat. No. 4,989,877.

In these respects, the golf swing practice device according to the present invention substantially departs from the conventional concepts and designs of the prior art, and in so doing provides an apparatus primarily developed for the purpose of practicing a golf swing with a rotating tether-mounted golf ball.

SUMMARY OF THE INVENTION

In view of the foregoing disadvantages inherent in the known types of golf swing aids now present in the prior art, the present invention provides a new golf swing practice device construction wherein the same can be utilized for practicing a golf swing with a rotating tether-mounted golf ball.

The general purpose of the present invention, which will be described subsequently in greater detail, is to provide a new golf swing practice device apparatus and method which has many of the advantages of the golf swing aids mentioned heretofore and many novel features that result in a new golf swing practice device which is not anticipated, rendered obvious, suggested, or even implied by any of the prior art golf swing aids, either alone or in any combination thereof.

To attain this, the present invention generally comprises a base having a planar rectangular configuration with a top face, a bottom face and a periphery formed therebetween. Such periphery is defined by a pair of short end edges and a pair of elongated side edges. In the preferred embodiment, the base is constructed from a weighted metallic material. As shown in FIGS. 1 & 2, the base includes a pair of eye bolts each having a bolt coupled between the top face and the bottom face of the base at a corner thereof. The coupling of the eye bolts and the base is preferably accomplished via a nut. Such nut is preferably covered by way of an elastomeric foot. Next provided as components of the base are a pair of cylindrical dowels each mounted within loops of the eye bolts. As such, the dowels remain in parallel relationship with the end edges of the base. For maintaining the dowels fixed within the loops of the eye bolts, a plurality of cotter pins are mounted on ends of the dowels. Handles are thus afforded for carrying purposes. FIG. 2 shows a mounting assembly including an upper compartment having a planar circular top face with a first diameter. A peripheral lip is integrally coupled to the top face and extends downwardly therefrom. Associated therewith is a lower compartment having a planar circular intermediate face with a second diameter greater than the first diameter. Similar to the top face, the intermediate face has a peripheral lip integrally coupled thereto and extending downwardly therefrom. A peripheral flange is integrally coupled to a lower edge of the peripheral lip of the intermediate face and extends radially therefrom. A plurality of bores are formed in the peripheral flange for being boltedly coupled to the top face of the base at a central extent thereof. With continuing reference to FIG. 2, a rotating assembly is provided including a central disk-shaped gear rotatably mounted within the upper compartment of the mounting assembly. Such central disk-shaped gear has an upper post concentrically coupled thereto and extending upwardly through a hole formed in the top face of the mounting assembly. A lower post is concentrically coupled to the central disk-shaped gear and extends downwardly through a hole formed in the intermediate face of the mounting assembly. Such lower post is adapted for being received within a bearing assembly positioned within the lower compartment. The rotating assembly further includes a pinion gear with a diameter smaller than that of the central disk-shaped gear. As shown in FIGS. 2 & 3, the pinion gear is rotatably mounted to the intermediate face of the mounting assembly and in engagement with the central disk-shaped gear for urging the same to a stationary position. Finally, a ball swinging mechanism includes a couple with an axial opening formed in a bottom thereof for releasably receiving the upper post of the rotating assembly. The couple thus rotates coincidentally with the rotating assembly. A flexible resilient arm has a first end connected to the couple and a second end extending upwardly and radially outwardly to terminate with an eyelet. A flexible inelastic tether cord has a top end with a spring clip for releasably coupling with the eyelet. Lastly, a bottom end of the tether is equipped with a golf ball for being hit by a user and spun about a vertical axis.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing practice device apparatus and method which has many of the advantages of the golf swing aids mentioned heretofore and many novel features that result in a new golf swing practice device which is not anticipated, rendered obvious, suggested, or even implied by any of the prior art golf swing aids, either alone or in any combination thereof.

It is another object of the present invention to provide a new golf swing practice device which may be easily and efficiently manufactured and marketed.

It is a further object of the present invention to provide a new golf swing practice device which is of a durable and reliable construction.

An even further object of the present invention is to provide a new golf swing practice device which is susceptible of a low cost of manufacture with regard to both materials and labor, and which accordingly is then susceptible of low prices of sale to the consuming public, thereby making such golf swing practice device economically available to the buying public.

Still yet another object of the present invention is to provide a new golf swing practice device which provides in the apparatuses and methods of the prior art some of the advantages thereof, while simultaneously overcoming some of the disadvantages normally associated therewith.

Still another object of the present invention is to provide a new golf swing practice device for practicing a golf swing with a rotating tether-mounted golf ball.

Even still another object of the present invention is to provide a new golf swing practice device that includes a base and a ball swinging mechanism including an arm having a first end rotatable with respect to the base about a vertical axis. The ball swinging mechanism further includes a tether cord having a top end coupled to a second end of the arm. A bottom end of the tether cord is equipped with a golf ball fixed thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
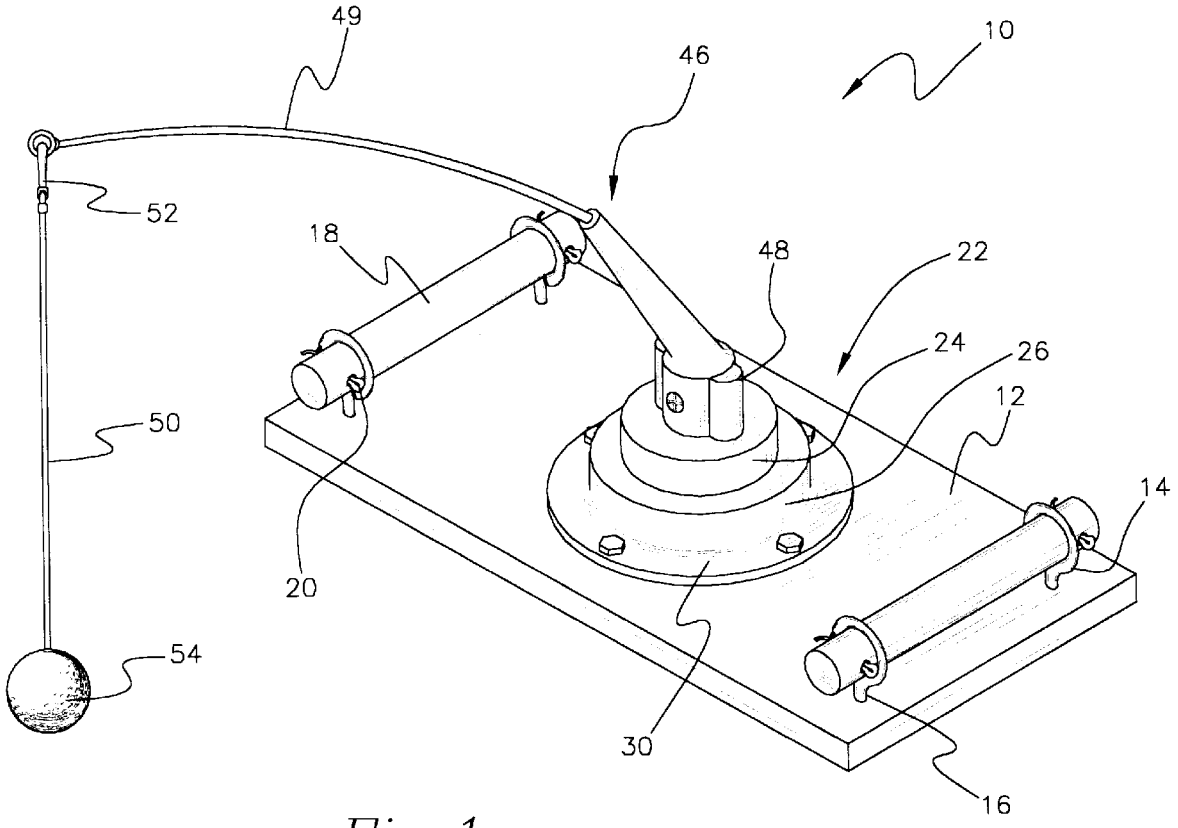
FIG. 1 is a perspective view of a new golf swing practice device according to the present invention.

With reference now to the drawings, and in particular to FIGS. 1 through 5 thereof, a new golf swing practice device embodying the principles and concepts of the present invention and generally designated by the reference numeral 10 will be described.

The present invention, designated as numeral 10, includes a base 12 having a planar rectangular configuration with a top face, a bottom face and a periphery formed therebetween. Such periphery is defined by a pair of short end edges and a pair of elongated side edges. Ideally, the base is 12 inches long and 6 inches wide. In the preferred embodiment, the base is constructed from a weighted metallic material to afford a weight of at least 10 lbs.

Figure 2:
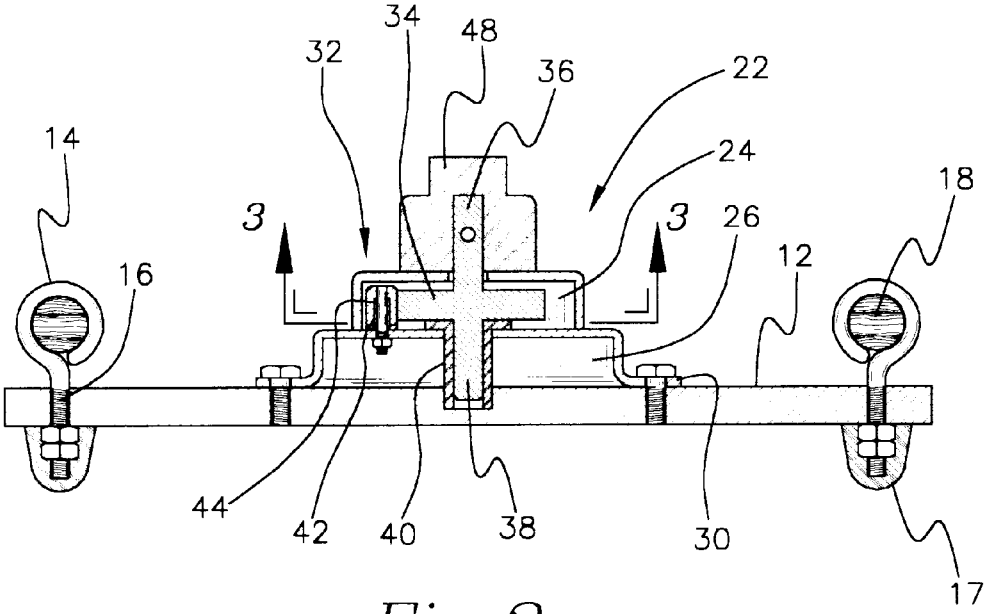
FIG. 2 is a side cross-sectional view of the present invention.

As shown in FIGS. 1 & 2, the base includes a pair of eye bolts 14 each having a bolt 16 coupled between the top face and the bottom face of the base at a corner thereof. The coupling of the eye bolts and the base is preferably accomplished via at least one nut. Such nut is preferably covered by way of an elastomeric foot 17.

Next provided as components of the base are a pair of cylindrical wooden dowels 18 each mounted within loops of the eye bolts. As such, the dowels remain in parallel relationship with the end edges of the base. For maintaining the dowels fixed within the loops of the eye bolts, a plurality of cotter pins 20 are mounted on ends of the dowels. Handles are thus afforded for carrying purposes.

FIG. 2 shows a mounting assembly 22 including an upper compartment 24 having a planar circular top face with a first diameter. A peripheral lip is integrally coupled to the top face and extends downwardly therefrom. Associated therewith is a lower compartment 26 having a planar circular intermediate face with a second diameter greater than the first diameter and a height equal to that of the upper compartment. The intermediate face is preferably integrally coupled to the peripheral lip of the top face, as shown in FIG. 2. Similar to the top face, the intermediate face has a peripheral lip integrally coupled thereto and extending downwardly therefrom. A peripheral flange 30 is integrally coupled to a lower edge of the peripheral lip of the intermediate face and extends radially therefrom. A plurality of bores are formed in the peripheral flange for being boltedly coupled to the top face of the base at a central extent thereof.

Figure 3:
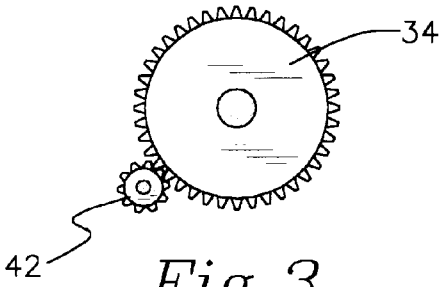
FIG. 3 is a top cross-sectional view of the gears of the rotating assembly of the present invention taken along line 3—3 shown in FIG. 2.
Figure 4:
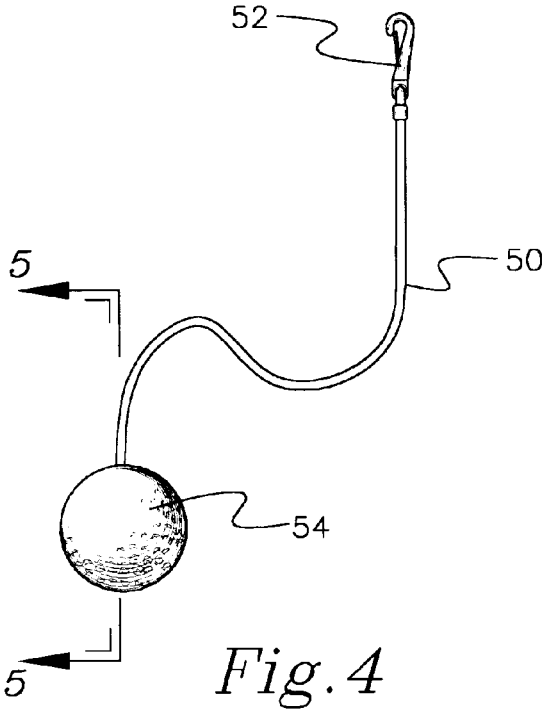
FIG. 4 is a side view of the tether and ball of the ball swinging assembly of the present invention.

With continuing reference to FIG. 2, a rotating assembly 32 is provided including a central disk-shaped gear 34 rotatably mounted within the upper compartment of the mounting assembly. Such central disk-shaped gear has an upper post 36 concentrically coupled thereto and extending upwardly through a hole formed in the top face of the mounting assembly. A lower post 38 is concentrically coupled to the central disk-shaped gear and extends downwardly through a hole formed in the intermediate face of the mounting assembly. Such lower post is adapted for being received within a bearing assembly 40 positioned within the lower compartment. The rotating assembly further includes a pinion gear 42 with a diameter smaller than that of the central disk-shaped gear. As shown in FIGS. 2 & 3, the pinion gear is rotatably mounted to the intermediate face of the mounting assembly and in engagement with the central disk-shaped gear for urging the same to a stationary position. To accomplish this, a friction element 44 such as an elastomeric bushing or the like is situated between the pinion gear and a post on which it is rotatably mounted.

Figure 5:
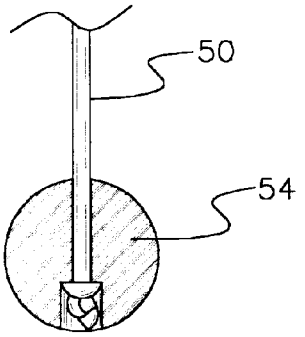
FIG. 5 is a side cross-sectional view of the present invention taken along line 5—5 shown in FIG. 4.

Finally, a ball swinging mechanism 46 includes a couple 48 with an axial opening formed in a bottom thereof for releasably receiving the upper post of the rotating assembly. Both the couple of the ball swinging mechanism and the upper post of the rotating assembly include a diametrically opposed threaded and smooth bore formed therein, respectively, for releasably receiving a threaded fastener to maintain a fixed relationship. The couple thus rotates coincidentally with the rotating assembly. A 20 inch flexible resilient arm 49 has a first end connected to the couple and a second end extending upwardly and radially outwardly to terminate with an eyelet. Ideally, the arm is constructed from a steel material and has a grommet sleeve positioned along an inboard extent thereof for support purposes. A flexible inelastic tether cord 50 has a top end with a spring clip 52 for releasably coupling with the eyelet. Lastly, a bottom end of the tether is equipped with a golf ball 54 for being hit by a user and spun about a vertical axis. As shown in FIG. 5, a dual diameter diametrically disposed bore is formed in the ball for receiving a knot on the tether cord. Ideally, a length of the tether cord is sufficient to maintain the ball slightly above a plane in which the base resides. In use, the gears work to expeditiously slow the rotation of the ball swinging mechanism such that the ball may be promptly struck again.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf practice aid comprising, in combination:

a base having a planar rectangular configuration with a top face, a bottom face and a periphery formed therebetween defined by a pair of short end edges and a pair of elongated side edges, the base including a pair of eye bolts each having a bolt coupled between the top face and the bottom face of the base at a corner thereof via a nut which is covered by way of an elastomeric foot, a pair of cylindrical dowels each mounted within loops of the eye bolts such that the same remain in parallel relationship with the end edges of the base, and a plurality of cotter pins mounted on ends of the dowels for maintaining the same fixed within the loops of the eye bolts for affording handles;

a mounting assembly including an upper compartment having a planar circular top face with a first diameter and a peripheral lip integrally coupled to the top face and extending downwardly therefrom, a lower compartment having a planar circular intermediate face with a second diameter greater than the first diameter and a peripheral lip integrally coupled to the intermediate face and extending downwardly therefrom, and a peripheral flange integrally coupled to a lower edge of the peripheral lip of the intermediate face and extending radially therefrom with a plurality of bores formed therein for being boltedly coupled to the top face of the base at a central extent thereof;

a rotating assembly including a central disk-shaped gear rotatably mounted within the upper compartment of the mounting assembly and having an upper post concentrically coupled thereto and extending upwardly through a hole formed in the top face of the mounting assembly and a lower post concentrically coupled to the central disk-shaped gear and extending downwardly through a hole formed in the intermediate face of the mounting assembly for being received within a bearing assembly positioned within the lower compartment, the rotating assembly further including a pinion gear with a diameter smaller than that of the central disk-shaped gear and rotatably mounted to the intermediate face of the mounting assembly and in engagement with the central disk-shaped gear for urging the same to a stationary position; and a ball swinging mechanism including a couple with an axial opening formed in a bottom thereof for releasably receiving the upper post of the rotating assembly so as to rotate coincidentally therewith, a flexible resilient arm having a first end connected to the couple and a second end extending upwardly and radially outwardly to terminate with an eyelet, a flexible inelastic tether cord having a top end with a spring clip for releasably coupling with the eyelet and a bottom end with a golf ball fixed thereto.

2. A golf practice aid comprising:

a base;

a mounting assembly including upper and lower compartments, the lower compartment having a peripheral flange coupled to the base;

a rotating assembly including a central gear rotatably mounted in the upper compartment of the mounting assembly;

the central gear having an upper post upwardly extending therefrom and through a hole formed in a top face of the mounting assembly;

the central gear having a lower post extending downwardly therefrom and through a hole formed in an intermediate face of the mounting assembly, the lower post being rotatably mounted to the lower compartment;

the rotating assembly further including a pinion gear rotatably mounted to the intermediate face of the mounting assembly and in engagement with the central gear for urging the center gear to a stationary position; and a ball swinging mechanism including a couple receiving therein the upper post;

the ball swinging mechanism further including an arm having a first end coupled to the couple, the ball swinging mechanism further including a tether cord having a top end coupled to a second end of the arm and a bottom end with a golf ball fixed thereto.

3. A golf practice aid as set forth in claim 2 wherein the arm is resilient.

4. A golf practice aid as set forth in claim 2 wherein the base is weighted and has a pair of handles mounted thereon.

5. A golf practice aid as set forth in claim 4 wherein each handle includes a pair of eye bolts each being extended through the base and each having a nut disposed there around beneath the base, each handle further including a dowel extended through loops of the eye bolts of the respective handle, and a plurality of cotter pins mounted on ends of the dowel for maintaining the respective dowel fixed in the loops of the associated eye bolts.

6. A golf practice aid as set forth in claim 5 wherein the nuts are covered by elastomeric feet.

7. A golf practice aid as set forth in claim 2 wherein the tether is releasably mounted on the arm.

8. A golf practice aid as set forth in claim 2 wherein the base has a planar rectangular configuration with a top face, a bottom face and a periphery formed therebetween defined by a pair of short end edges and a pair of elongated side edges.

9. A golf practice aid as set forth in claim 2 wherein the top end of the tether cord has a spring clip for releasably coupling with an eyelet at the second end of the arm.

* * * * *